United States Patent [19]

Krueger

[11] Patent Number: 4,593,262

[45] Date of Patent: Jun. 3, 1986

[54] TIME DELAY INDICATOR FUSE

[75] Inventor: David J. Krueger, Arlington Heights, Ill.

[73] Assignee: Littelfuse, Inc., Des Plaines, Ill.

[21] Appl. No.: 715,097

[22] Filed: Mar. 22, 1985

[51] Int. Cl.[4] ..... H01H 85/04; H01H 85/30

[52] U.S. Cl. ..... 337/163; 337/165; 337/183; 337/244; 337/164

[58] Field of Search ..... 337/163, 164, 165, 166, 337/232, 238, 239, 241, 265, 267, 183, 184, 244

[56] References Cited

U.S. PATENT DOCUMENTS 2,111,749 3/1938 Bussmann ..... 337/164

4,058,784 11/1977 Gaia ..... 337/164

*Primary Examiner*—Harold Broome

*Attorney, Agent, or Firm*—Russell E. Hattis

[57] ABSTRACT

A fuse (12) for protecting a circuit and comprising a tube (14) of insulating material having an inner wall surface (16) and an outer wall surface (18) so as to form a fuse housing. The fuse includes two opposite axial ends (20) and (22), and a first (24) and a second conductive fuse terminal (26) are secured to the tube adjacent each of those opposite axial ends, respectively. Serially-located elements (28) are disposed within the fuse housing and provide electrical continuity between the first fuse terminal and the second fuse terminal. The elements comprise stressed spring means (30) and resistor means (32), with the spring means having a proximate end (40) secured to the fuse adjacent the first fuse terminal and a distal end (41) secured through a meltable junction (34) to the resistor means.

9 Claims, 6 Drawing Figures

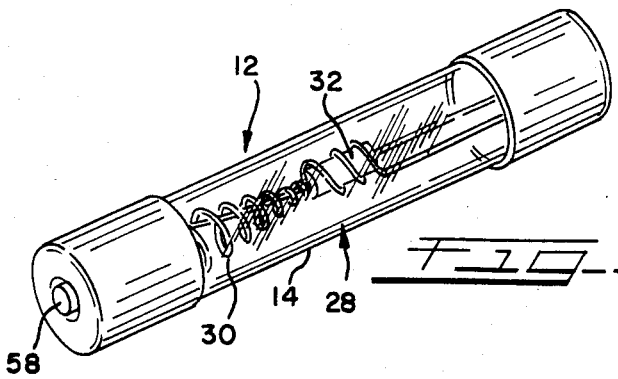
FIG. 1
FIG. 2
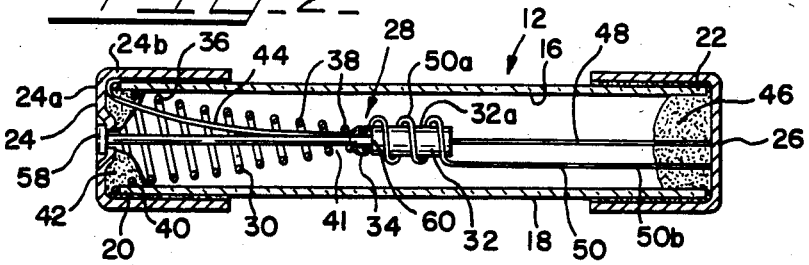
FIG. 3
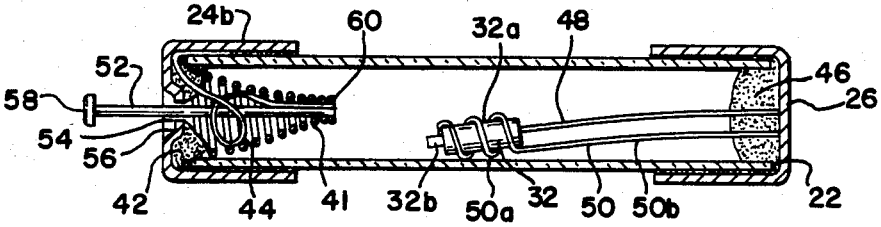
FIG. 4
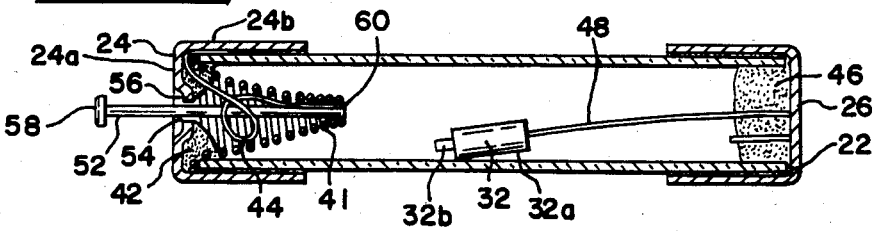

TIME DELAY INDICATOR FUSE

TECHNICAL FIELD

This invention has two important applications, the first in slow blowing, tubular fuses of the type having a spring, a heat sink, and a thin fusible element, and which are particularly well suited for protecting electric motor starting circuits. Such fuses are designed to break an electrical circuit after either a predetermined interval under a sustained modest overload, or almost immediately under a given high overload, as, for example, under short circuit, high energy, arc-producing conditions.

This first application of the present invention relates to a unique fuse construction and arrangement for removing the inherent stress upon the thin, fragile fusible element within such prior art fuses so as to avoid breakage of the element when such fuses are either dropped or subjected to external vibration forces.

The second important application pertains to an indicator unit that may be placed in parallel with a fuse of virtually any construction so as to provide a blown fuse indication upon the blowing of the existing fuse. The indicator is generally similar in construction to the fuse described above, but does not include the thin fusible element.

DESCRIPTION OF THE PRIOR ART

Tubular fuses for protecting electrical circuits are well-known and generally include a cylindrical insulating housing made, for example, of glass. The opposite axial ends of the cylindrical housing are closed by a pair of generally cup-shaped fuse end terminals. A globule of molten solder is typically placed within each of the fuse terminals just prior to their assembly with the housing. As the solder cools, it solidifies so as to secure the fuse terminals to the outer wall surface at the ends of the housing. The solidified solder also supports serially-located elements disposed within the fuse housing and providing electrical continuity through the fuse between the fuse terminals.

Certain prior art slow blowing fuses of this general type include a tensed metal coil spring having one of its ends secured to one of the fuse terminals, and its other end connected through a heat meltable joint to the coiled end portion of a fuse wire. The other end portion of the fuse wire is straight and extends to the opposite fuse terminal. The coiled portion of the fuse wire is wound around a heat sink-forming core of ceramic or other insulating material which is in physical contact with the meltable joint. The spring and/or a shunt-forming conductor connected across the ends of the spring provides electrical continuity between the fuse wire and the former terminal. The coil spring is held in its expanded tensed condition by the meltable joint and it imparts tension upon the fuse wire.

Upon prolonged, modest overload conditions within the protected circuit, the heat generated by current flow through the coiled portion of the fuse wire wound around the core heats the core to a point where the meltable joint in contact therewith melts or softens sufficiently that the spring pulls away from the meltable joint and collapses towards the adjacent, former fuse terminal. In one fuse, the spring is connected to and surrounds an axially-extending indicator pin which is normally fully retracted within the fuse housing. The collapse of the spring pulls the shunt-forming conductor and indicator pin away from the fuse wire to open the protective circuit, and moves the indicator pin through a hole in the former fuse terminal where it projects from the housing so as to indicate a blown fuse condition.

Upon a short circuit condition, the mid-section of the straight portion of the fuse wire, which is space from the heat sink-forming core, melts or vaporizes and the coil spring then collapses and pulls the coiled portion of the fuse wire away from the opposite end of the fuse housing, to fully open the circuit involved and prevent the formation of a sustained arc at the point where the fuse wire had melted.

When the fuse is not in use or when in use under normal current conditions, the spring tension on the fuse wire does not give rise to problems if the fuse wire is of a substantial diameter, as it usually is in high current rated fuses. However, low current rated fuses frequently have thin, fragile fuse wire, and the spring tension applied thereto sometimes causes the fuse wire to break, permanently damaging the fuse, when dropped or subjected to external vibration forces.

It is thus an object of one aspect of this invention to design a fuse so that the tensed coil spring will not be a contributing factor to breakage of the fuse wire.

Another aspect of the invention enables the retrofit of indicator fuses to existing fuse-protected circuits. These existing circuits will typically not have fuses with integral indicators, and the present indicator fuses will, when placed in parallel with the existing fuses, provide them with a blown fuse indication.

SUMMARY OF THE INVENTION

In accordance with one aspect of the present invention, the need to place spring tension on the fuse wire for a quick separation under short circuit conditions of the fuse element parts as just described is eliminated by designing the fuse to open under short circuit conditions in a two step manner. To this end, the ceramic insulator previously described is replaced by a resistor, such as a carbon resistor, having an insulating body around which the coiled portion of the fuse wire is wound. The resistor body acts as a heat sink and is in contact, along with the short stub of the adjacent resistor terminal lead, with the spring-connected meltable joint.

The other terminal lead of the resistor and the straight, end portion of the fuse wire are secured to the adjacent fuse terminal at the end of the fuse housing, and this terminal, through the resistor's other terminal lead, takes the spring tension imparted by the spring. The fuse wire is connected in parallel across the resistor terminal leads such that there is no tension from the coil spring upon the fuse wire. The resistance value of the resistor is many times the resistance of the coiled heater-forming portion of the fuse wire so that when the fuse is in an intact, unblown state, practically all of the current flowing through the fuse flows through the fuse wire.

Under steady, prolonged overload current conditions, the overload current heats the coiled portion of the fuse wire which, in turn, heats the resistor body. As the temperature of the resistor body increases, after the passage of a sufficient time, the meltable joint adjacent thereto melts. The coil spring, which is mechanically connected to the resistor body and fuse wire through the meltable joint, collapses away from the resistor and fuse wire, to interrupt electrical continuity within the fuse, as in the prior art fuse previously described.

Under sudden, short circuiting conditions, the straight portion of the fuse wire melts or vaporizes abruptly. The resistor, in parallel with the heating coil, still provides a path through which current may flow. The resistor body heats up in a very short time and causes a rapid melting of the adjacent meltable joint while the coil spring collapses and opens the entire fuse, as described above.

The fuse may include an indicator pin as described, movable from a retracted position within the fuse housing to an extended position, thereby providing a blown fuse indication for the prolonged overload and short circuit conditions.

In accordance with a second aspect of the present invention, an indicator unit of a construction substantially similar to that of the two-step fuse described hereinabove is provided. The indicator unit differs from the two-step fuse in that it does not include the fuse wire that is connected in parallel across the resistor terminal leads.

The indicator unit is placed in parallel with a second fuse. The fuse is of a substantially lower resistance than that of the indicator unit, so that most of the current flowing through the protected circuit passes through the fuse. Upon the blowing of the fuse from either steady overload conditions or sudden, short circuit conditions, the relatively high resistance of the indicator unit reduces current flow through the protected circuit. The current which then flows through the indicator unit causes it to operate in a manner that is virtually identical to that of the above-described two-step fuse after short-circuit conditions have evaporated or melted the fuse wire. Specifically, the resistor body of the indicator unit heats up in a very short time and causes a rapid melting of its adjacent meltable joint. The coil spring then collapses, which opens the circuit path through the indicator unit. The indicator pin thus moves to its extended position to provide a blown fuse indication for the separate blown fuse.

BRIEF DESCRIPTION OF SEVERAL VIEWS OF DRAWINGS

FIG. 1 is a perspective view of a preferred form of the slow blow fuse of the invention;

FIG. 2 is a longitudinal sectional view through the fuse of FIG. 1;

FIG. 3 is a view of the fuse of FIG. 2 after the fuse has blown due to prolonged, moderate overload current conditions;

FIG. 4 is a longitudinal sectional view of the fuse of FIG. 2 after blowing due to sudden, high overload or short circuiting conditions;

DETAILED DESCRIPTION OF EXEMPLARY FORM OF INVENTION

Figure 5:
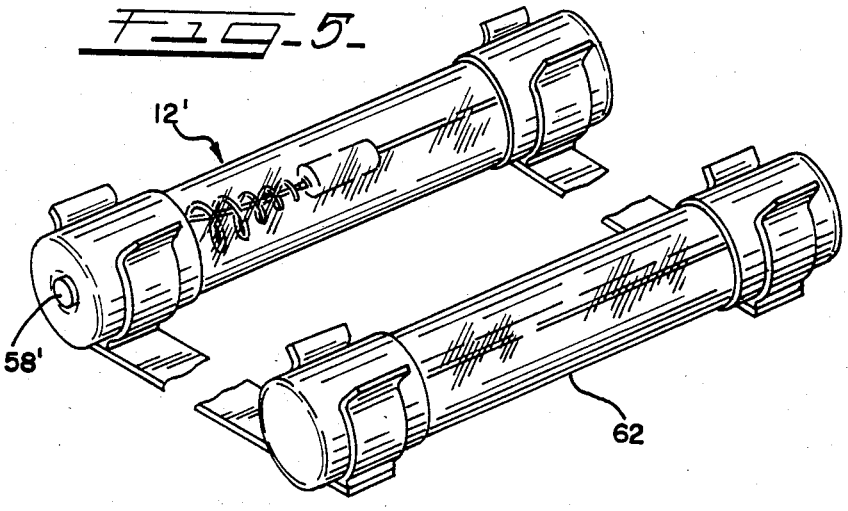
FIG. 5 is a schematic perspective view of the indicator unit of the present invention in parallel with a separate fuse.

Refer now to the fuse shown in FIGS. 1–4 and generally indicated by reference numeral 12. The fuse comprises a housing in the form of a tube 14 of insulating material such as transparent glass and having an inner wall surface 16 and an outer wall surface 18 and two opposite axial ends 20 and 22. A first cup-shaped metal fuse terminal 24 is secured to axial end 20 and a second cup-shaped metal fuse terminal 26 is secured in a like manner to opposite axial end 22.

The fuse includes serially-located elements 28 disposed within the fuse housing and providing electrical continuity between the first fuse terminal 24 and the second fuse terminal 26. The elements comprise an elongated, stressed spring 30 and a resistor 32 having an insulating outer housing or body **32*a*, the spring and resistor being mechanically and electrically secured to each other at a meltable joint or junction 34**.

In this embodiment, the stressed spring 30 is preferably conical and is tapered inwardly from relatively wide turns 36 adjacent the first fuse terminal 24 to relatively narrow turns 38 adjacent to the meltable junction 34. As may be seen in FIGS. 2–4, the proximate end 40 of the spring 30 is mechanically and electrically secured to the first fuse terminal 24. To that end, a solder globule 42 is placed in the first fuse terminal 24, and the terminal 24 is then secured over the axial end 20 of tube 14 so that the end wall **24*a* of the terminal 24 traps the widest and endmost turn of the spring 30 between the terminal end wall 24*a* and the tube end 20. Cooling of the solder globule results in a good mechanical and electrical connection between the fuse terminal, housing, and spring. The other end of the spring is secured with the spring under tension to the meltable junction 34 along with one end of a metal shunt-forming strap or wire 44. The other end of the metal strap 44 is preferably placed in the gap between the cylindrical wall 24*b* of the terminal 24 and the tube 14, into which gap some of the solder 42 is drawn by capillary action. The resistor body 32*a*** is in contact with the meltable juntion.

The resistor 32 can be of any suitable electrically conducting material. Its resistance may be, for example, 250 ohms. One terminal lead **32*b* of the resistor is mechanically secured to the spring 30 through the meltable junction 34**.

The other terminal lead 48 of the resistor is electrically connected to the second fuse terminal 26 through a solder globule 46 securing the second fuse terminal 26 to the axial end 22 of the tube 14. It will be appreciated that in this manner the tension imparted by the stressed conical spring 30 to the meltable junction 34 and the rest of the assembly thus far described is entirely taken up by the resistor 32 and the meltable junction 34.

The meltable junction 34 may comprise a globule of solder or other suitable substance which is solid at the normal operating temperatures of fuses, and capable of providing a solid mechanical and a good, low resistance electrical connection between the resistor and the spring. The shunt wire 44 provides a low resistance shunt between the first fuse terminal 24 and the meltable junction 34, so that spring 30 need not be made of very low resistance conductive material.

The resistor body **32*a* is surrounded by the coiled portion 50*a* of a fuse wire 50 having a straight portion 50*b*. The fuse wire is loosely, that is with only modest tension, connected across the resistor leads so that it takes none of the tension imparted by the spring 30. Under prolonged overload, i.e. usually at or above 135% rated current, the coiled portion 50*a* of the fuse wire, which is so low in resistance as compared to the resistance of resistor 32 that is carries practically all of the current flowing through the fuse, becomes appreciably heated. This heat is transferred to the resistor body 32*a*. When the current flows for a given period, the resistor body 32*a* reaches a temperature which melts the junction 34 so that the tensed spring 30 collapses to separate the spring from the resistor 32 and fuse wire 50 as shown in FIG. 3**.

Under short circuit conditions, the fuse wire 50 melts or vaporizes, whereupon the current in the circuit is transferred to the resistor 32 which heats up and melts the junction 34. The collapsing spring 41 pulls away from the resistor to open the fuse. The normal current, i.e., current at 110% or less of the rated amperage of the fuse, passing through the coiled portion of the fuse wire is too small to create sufficient heat to melt meltable junction 34.

Under steady, prolonged overload current conditions, the overload current heats the coiled portion **50*a* of the fuse wire 50 which, in turn, heats the resistor body 32*a*. As the temperature of the resistor body increases, after the passage of a sufficient time, the meltable joint 34 adjacent thereto melts. The coil spring 30**, which is mechnically connected to the resistor body and fuse wire through the meltable joint, collapses away from the resistor and fuse wire, to interrupt electrical continuity within the fuse.

The fuse may include an indicator pin 52 movable from a retracted position within the fuse as shown in FIG. 2 to an extended position, partially without the fuse, as shown in FIGS. 3 and 4. In this embodiment, the indicator pin moves to its extended position upon the collapse of the coil spring 30 after the melting of the meltable junction.

The indicator pin 52 is guidably mounted in an axially central aperture 54 in the end wall **24*a* of the first fuse terminal 24, and the terminal further includes a recessed portion 56 so that the head 58 of the indicator pin will be substantially flush with the rest of the exterior portion of end wall 24*a* when the fuse is in its normal unblown state. In this embodiment, the distal end 60 of the indicator pin 52 is clampingly engaged by one of the narrow turns 38 of the stressed spring 30. When the spring collapses upon the melting of the meltable junction 34, each of the turns of the spring moves in the direction of the first fuse terminal 24. The turn clampingly engaging the distal end 60 of the indicator also necessarily moves towards the first fuse terminal 24 under such blown fuse conditions. As a result, the distal end of the indicator pin 52 is urged towards the first fuse terminal 24, and the head 58 of the indicator is moved away from the recessed portion 56 so that the pin 52 is in the extended position shown in either FIGS. 3 or 4**. In this extended position, the indicator provides the user with a blown fuse indication.

This aspect of the present invention provides all of the advantages of the prior art fuses and the additional advantage of durability in that it includes a fine fuse filament or heating coil element that is not under spring tension and is thus not as likely to break if the fuse is dropped or subjected to substantial vibration. The fuse is economical to manufacture and can be used in any environment where prior art slow blow fuses have been used.

A second important aspect of this invention comprises an indicator unit 12' shown generally in FIG. 6 and shown in FIG. 5 in parallel with a separate fuse 62 so as to provide an indication of a blown fuse condition for the fuse, as will be explained hereinbelow. Referring now to FIG. 6, the indicator unit is substantially identical to the fuse of FIG. 2, except that it does not have the fuse wire 50. Thus, the unit comprises a housing in the form of a tube 14' of insulating material, such as transparent glass, and having an inner wall surface 16' and an outer wall surface 18' and two opposite axial ends 20' and 22'. A first cup-shaped metal terminal 24' is secured to axial end 20' and a second cup-shaped metal terminal 26' is secured in a like manner to opposite axial end 22'. The indicator unit includes serially-located elements disposed within the housing thereof and providing electrical continuity between the first terminal 24' and the second terminal 26'. The elements comprise an elongated stressed spring 30' and a resistor 32' having an insulating outer housing or body **32*a'*, the spring and resistor being mechanically and electrically secured to each other at a meltable joint or junction 34'. One end of a metal shunt-forming strap or wire 44' is also anchored to the meltable junction 34'. The other end of the metal strap 44' is placed in the gap between the cylindrical wall 24*b'* of the terminal 24' and the tube 14'**.

Figure 6:
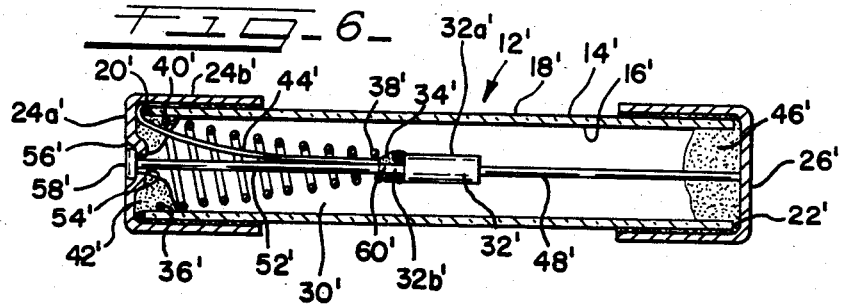
FIG. 6 is a longitudinal sectional view of the indicator unit of FIG. 5, showing the indicator unit in an intact, unblown state.

The indicator unit also includes an indicator pin 52' movable from a retracted position within the fuse as shown in FIG. 5 to an extended position, partially outside of the unit, as exemplified by the two-step fuse in its blown condition in FIGS. 3 and 4. The indicator pin moves to its extended position upon the collapse of the coil spring after the melting of the meltable junction.

Since the indicator unit 12' is, except for the absence of the fuse wire, identical to the fuse of FIG. 2, a further description of the parts of the indicator unit will not be given, but primed reference numbers have been given to the various parts of the indicator unit corresponding to the unprimed numbers used for the corresponding parts shown in FIG. 2.

The operation of the indicator unit is as follows. Because the resistance of the indicator unit 12' is designed to be substantially higher than that of the fuse 62 through the inclusion of a suitably high-resistance resistor 32', under normal operating conditions most of the current passing through the protected circuit of FIG. 5 passes through fuse 62. Upon sudden, short circuiting conditions or under prolonged, steady overload conditions, the fuse 62 blows in accordance with its design characteristics. At this point, a very small current passing through the protected circuit can only pass through indicator unit 12'. The magnitude of this current will cause resistor 32' to heat, melting the meltable junction. The mechanical connection of the resistor with the spring will have thereby become destroyed, causing collapse of the spring and interrupted electrical contact. Under these conditions, the end 38' of the spring 30' clampingly engaging the indicator pin 52' will urge the pin into the partially extended position so as to provide the circuit with a blown fuse indication.

For example, while it is advantageous from a cost standpoint that modest prolonged overload currents which are to blow the fuse heat a coiled portion of a fuse wire surrounding the resistor body **32*a* so that the resistor body heats up to melt the meltable junction 34, the coiled portion 30*a* could, in accordance with the broadest aspect of the invention, be replaced by a resistor of much lower value than the load resistance of the circuit involved. This resistor is placed next to the resistor body 32*a* or junction 34** to melt the junction upon such a prolonged modest overload.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while generally specific claimed details of the invention constitute important specific aspects of the invention, in appropriate cases the specific claims involved should be construed in light of the Doctrine of Equivalents.

What I claim is:

1. A fuse for protecting a circuit, said fuse comprising a fuse housing, a first and a second conductive terminal in the housing for connection with an external circuit, serially-located elements disposed within said fuse housing and providing electrical continuity between said terminals, said elements including stressed spring means and resistor means, said spring means having a proximate end secured to said first terminal and a distal end secured through a meltable junction to said resistor means so that said junction holds said spring means in tension, said resistor means having an insulating outer body portion in heat transfer relation to said meltable junction, said resistor means further being in electrical parallel relation with a conductive path which includes heating means and which provides short circuit protection and which is isolated from the tension of said spring means, said conductive path being of a substantially lower resistance than that of said resistor means so that most of the current normally flows through said path, said heating means generating heat upon flow of current therethrough and being proximate to one of said resistor body means and metlable junction so that the meltable junction is directly or indirectly heated thereby, wherein under prolonged overload conditions which are to blow the fuse said meltable junction melts to collapse the spring and disconnect said heating means and resistor means from one of the terminals, and wherein under short circuit conditions, a part of said conductive path melts to open the path to thereby shift all resulting circuit current to said resistor means, which then heats up to melt said meltable junction and causes said spring to collapse and disconnect said resistor means from one of said terminals.

2. The fuse as set forth in claim 1 wherein said conductive path is formed by a fuse wire having a coiled portion surrounding said resistor body to form said heating means, and a portion of said conductive path blows under short circuit conditions.

3. The fuse as set forth in claim 1, wherein said fuse includes indicator means movable from a retracted position within said fuse to an extended position partially without said fuse upon the collapse of said coil spring to an unstressed position after the melting of said meltable junction so as to provide a blown fuse indication.

4. The fuse as set forth in claim 2, wherein said spring means is a conical spring tapered inwardly from relatively wide turns adjacent said first fuse terminal to relatively narrow turns adjacent said meltable junction, and wherein said indicator means is clampingly engaged at a distal end thereof by at least one of said relatively narrow turns whereby upon movement of said spring means from its stressed, extended position to its unstressed, retracted position after the melting of said meltable junction, said distal end is urged to said extended position in the direction of said first fuse terminal.

5. The fuse as set forth in claim 1, wherein electrical contact from said first terminal to said meltable junction is provided by a shunt wire.

6. An indicator unit for providing a blown fuse indication for a separate fuse connected in parallel therewith, said indicator comprising a housing, a first and a second terminal in the housing for connection with an external circuit, serially-located elements disposed within said housing and providing electrical continuity between said terminals, said elements comprising stressed spring means and resistor means, said spring means having a proximate end secured to said first terminal and a distal end secured through a meltable junction to said resistor means so that said junction holds said spring means in tension, said resistor means having an outer insulating body portion in heat transfer relation to said meltable junction and said resistance means having a substantially higher resistance than that of said separate fuse so that under normal operating conditions most of the current flow in said protected circuit flows through said separate fuse when said indicator and said fuse are in their unblown state, and wherein upon the blowing of said fuse, the lower resulting current which then flows through said protected circuit flows through said indicator, thereby heating the body portions of said resistor means to a point where it melts said meltable junction to collapse the spring and disconnect said resistor means from said second fuse terminal, and indicating means which has a first condition when said spring is stressed and a second condition indicating a blown fuse when said spring has collapsed.

7. The indicator unit as set forth in claim 6, wherein said fuse includes indicator means movable from a retracted position within said fuse to an extended position partially without said fuse upon the collapse of said coil spring to an unstressed position after the melting of said meltable junction so as to provide a blown fuse indication.

8. The indicator unit as set forth in claim 7, wherein said spring means is a conical spring tapered inwardly from relatively wide turns adjacent said first terminal to relatively narrow turns adjacent said meltable junction, and wherein said indicator means is clampingly engaged at the distal end thereof by at least one of said relatively narrow turns, wherein upon movement of said spring means from its stressed, extended position to its unstressed, retracted position after the melting of said meltable junction, said distal end is urged to said extended position in the direction of said first fuse terminal.

9. The indicator unit as set forth in claim 6, wherein there is provided electrical contact from said first fuse terminal to said meltable junction is provided by a shunt wire.

* * * * *